US005762015A

United States Patent [19]

Tsuta

[11] Patent Number: 5,762,015

[45] Date of Patent: Jun. 9, 1998

[54] SEWING DEVIATION PREVENTIVE APPARATUS OF CLOTH SEWN BY SEWING MACHINE

[76] Inventor: Shigeharu Tsuta, 2-5-27 Nagata, Joto-ku, Osaka, Japan

[21] Appl. No.: 814,262

[22] Filed: Mar. 10, 1997

[30] Foreign Application Priority Data

Sep. 27, 1996 [JP] Japan ..... 8-257196

[51] Int. Cl.[6] ..... D05B 29/08; D05B 27/02; D05B 73/12

[52] U.S. Cl. ..... 112/235; 112/260; 112/324

[58] Field of Search ..... 112/235, 240, 112/260, 324, 236

[56] References Cited

U.S. PATENT DOCUMENTS

| | | | |
|---|---|---|---|
| 1,616,278 | 2/1927 | Parks | 112/235 |
| 1,943,203 | 1/1934 | Chudner | 112/235 |
| 2,198,312 | 4/1940 | Lyons | 112/260 X |
| 2,295,640 | 9/1942 | Cumfer | 112/260 |
| 2,366,113 | 12/1944 | Kessler | 112/235 |
| 2,700,351 | 1/1955 | Schaad | 112/324 |
| 3,496,894 | 2/1970 | Portnoff | 112/324 |

FOREIGN PATENT DOCUMENTS

| | | | |
|---|---|---|---|
| 2222554 | 11/1972 | Germany | 112/235 |
| 2210996 | 9/1973 | Germany | 112/235 |
| 261531 | 11/1988 | Germany | 112/235 |
| 991239 | 4/1963 | United Kingdom | 112/235 |

*Primary Examiner*—Ismael Izaguirre
*Attorney, Agent, or Firm*—Moonray Kojima

[57] ABSTRACT

The invention relates to a sewing deviation preventive apparatus of cloth sewn by sewing machine comprising a throat plate forming a needle hole through which a sewing needle penetrates, a feed dog moving in and out on the throat plate, and a cloth presser formed to be located above the needle hole, having a presser foot for pressing the cloth when sewing disposed at the leading end, wherein the abutting portion of the presser foot contacting with the cloth is coupled and supported by an elastic member, whereby the dislocation of the presser foot is allowed by deformation of the elastic member, the cloth can be always gripped stably corresponding flexibly to the thickness of the cloth, and the cloth can be fed stably and securely without causing corrugation, lashing, etc.

4 Claims, 6 Drawing Sheets

SEWING DEVIATION PREVENTIVE APPARATUS OF CLOTH SEWN BY SEWING MACHINE

BACKGROUND OF THE INVENTION

1. Field of the Invention

The present invention relates to a sewing deviation preventive apparatus of cloth sewn by a sewing machine for sewing a cloth.

2. Description of the Prior Art

Hitherto various means had been attempted to prevent sewing deviation of a cloth sewn by a sewing machine, but various defects were caused depending on the material of the cloth to be sewn, knitting and braiding method, etc., and sufficiently satisfactory methods had not been developed.

In particular, in finishing of bottom for sewing a thick fabric or the like, the fabric feed was often unstable, which impeded enhancement of quality. In the light of this problem, if a mechanism for varying the distance between the throat plate and cloth presser depending on the fabric thickness is employed, the structure is complicated, the cost is raised, and the problem is not solved fundamentally.

Recently, shape memory materials have been developed, and have come to be used as materials for shirt. In such materials, it is impossible to correct sewing deviation by a conventional method of shaping manually after sewing and ironing. It hence requires a more effective sewing deviation preventive apparatus of cloth sewn by sewing machine.

SUMMARY OF THE INVENTION

It is hence a primary object of the invention to present a sewing deviation preventive apparatus of cloth sewn by sewing machine, capable of allowing dislocation of presser foot by deformation of an elastic member by coupling and supporting the abutting portion of the presser foot contacting with the cloth by the elastic member, gripping the cloth always stably widely depending on the thickness of the cloth, and feeding securely without causing corrugation, lashing or other defects of the cloth.

It is other object of the invention to present a sewing deviation preventive apparatus of cloth sewn by sewing machine capable of achieving the above object by the elastic member disposed at the presser foot.

It is a different object of the invention to present a sewing deviation preventive apparatus of cloth sewn by sewing machine capable of achieving the above object by the elastic member disposed between the cloth presser main body and the presser foot.

It is other different object of the invention to present a sewing deviation preventive apparatus of cloth sewn by sewing machine, capable of simplifying the structure and facilitating the manufacture, and easily lowered in cost and reduced in size, by using a spring body made of a metal plate formed in a U-shape as the presser foot.

Further objects of the invention will be more clearly understood from the following detailed description.

DESCRIPTION OF THE PREFERRED EMBODIMENTS

Figure 1:
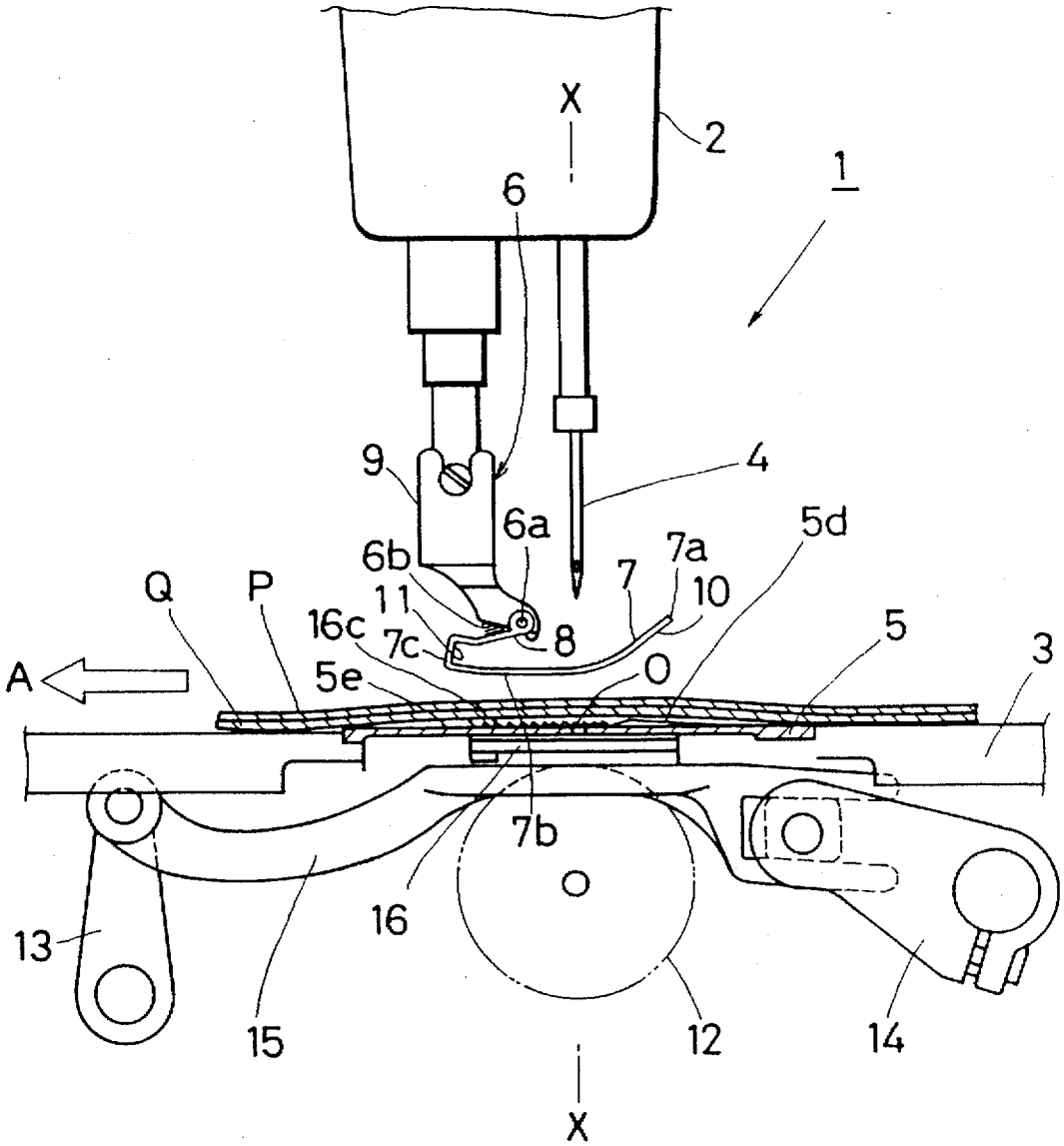
FIG. 1 is a partial front view of a sewing machine containing a sewing deviation preventive device of cloth sewn by sewing machine of the invention.

Referring now to the drawings, a preferred embodiment of the invention is described specifically below.

Figure 2:
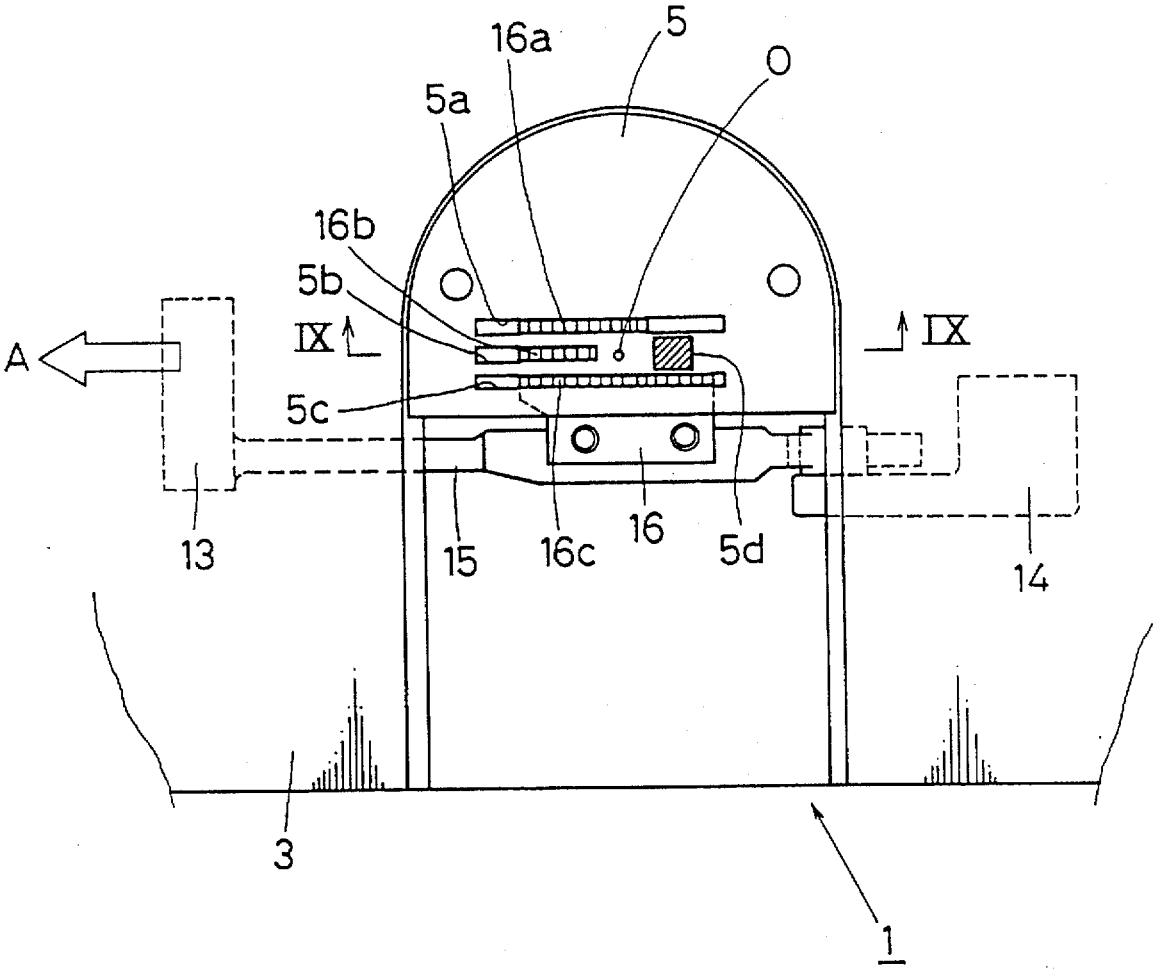
FIG. 2 is a partial plan view of FIG. 1.

The drawings show a sewing deviation preventive apparatus of cloth sewn by sewing machine, and in FIG. 1 and FIG. 2, reference numeral 1 is part of a sewing machine, which is provided with an arm 2 and a table 3. A needle 4 is provided beneath the arm 2, and a throat plate 5 forming a needle hole O for allowing the needle 4 to penetrate through is installed horizontally on the table 3. The needle 4 orthogonally crosses the throat plate 5, and moves reciprocally on center line X—X of ascending and descending motion.

Figure 3:
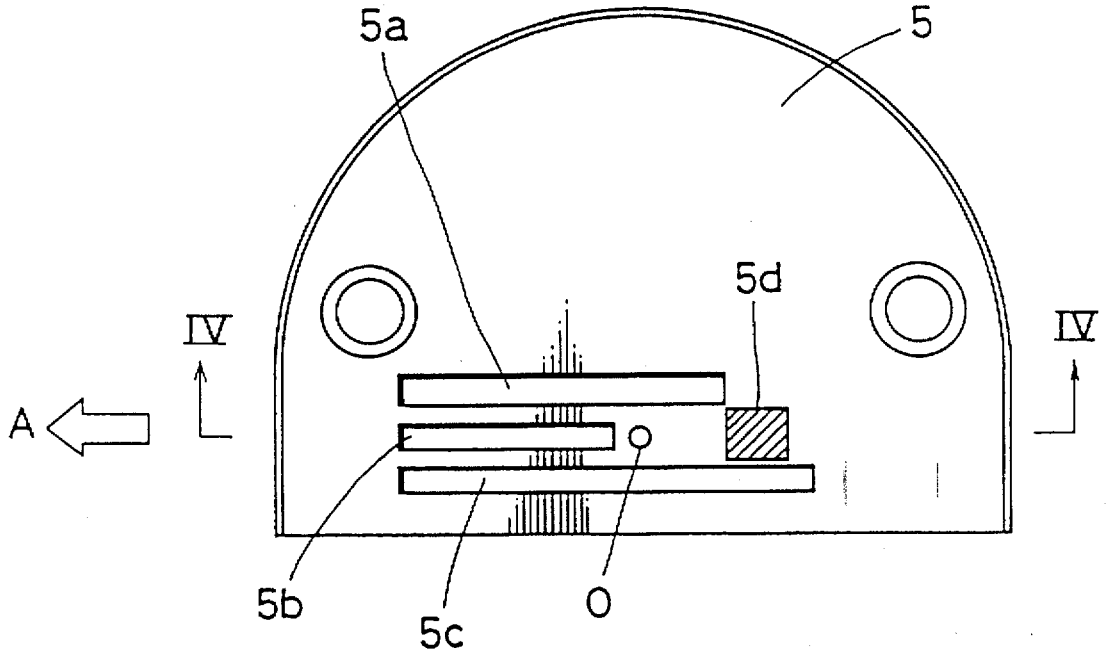
FIG. 3 is a plan view of a throat plate.
Figure 4:
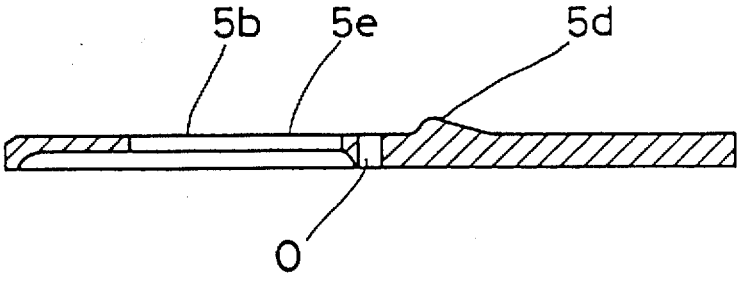
FIG. 4 is a sectional view along line IV—IV in FIG. 3.

As shown in FIG. 3 and FIG. 4, in the throat plate 5, three guide grooves **5*a*, 5*b*, 5*c* are formed in the running direction (arrow A) of fabrics (P, Q), and on both sides, in the relation of the length of the outside groove 5*c* longer and the length of the middle groove 5*b* shorter than the length of the inside groove 5*a*, so that a feed dog 16 may be free to move in and out as described later. Behind the throat plate 5 in the running direction (the right side in the drawing), a bump 5*d* (shaded in FIG. 3 for emphasis) is formed as being projected from the upper surface 5*e* of the throat plate 5 by about, for example, 1 mm. The bump 5*d*** is about 5 mm in the length in the direction of arrow A, and is formed in a sectional shape being upright in the front portion in the running direction and descending smoothly from the front end backward.

As shown in FIG. 1, above the throat plate 5, a cloth presser 6 ascending and descending parallel to the ascending and descending center line X—X is provided, and a presser foot 7 is provided at the leading end of the cloth presser 6. The presser foot 7 is a spring body made of metal plate formed in a U-shape (strictly speaking, a lateral U-shape), and a flange 8 at one side of the U-shape is rotatably supported through a cloth presser main body 9 and a horizontal shaft **6*a*, while a flange 10 at other side is disposed parallel to the upper surface 5*e* of the needle position 5 beneath apart from the flange 8. A coupler 11 for coupling the both flanges 8, 10 functions as an elastic member for allowing fluctuations of the interval of the both flanges 8, 10, and a downward thrusting force is applied to the flange 10 when gripping the fabrics P, Q as the cloth to be sewn between the presser foot 7 and throat plate 5. This coupler 11** is directed forward of the feed direction of the fabrics P, Q.

In the diagram, reference numeral **6*b* is a spring, and it is interposed between the cloth presser main body 9 and presser foot 7 ahead in the feed direction of the fabrics P, Q from the horizontal shaft 6***a*, and thrusts the coupler 11 side of the presser foot 7 downward.

The other flange 10 functions as abutting portion to contact with the fabrics P, Q.

Beneath the throat plate 5 are provided a hook 12, a feed rod 13, a vertical adjusting arm 14, and a feed bar 15. Inside the hook 12, although not shown, a bobbin is provided rotatably. The feed rod 13 and vertical adjusting arm 14 are rotatable laterally, and rotatable vertically, respectively. One end of the feed bar 15 is connected to the feed rod 13, and the other end of the feed bar 15 is connected to the vertical adjusting arm 14. On the upper surface of the feed bar 15, the feed dog 16 is spirally formed like a cantilever.

Figure 5:
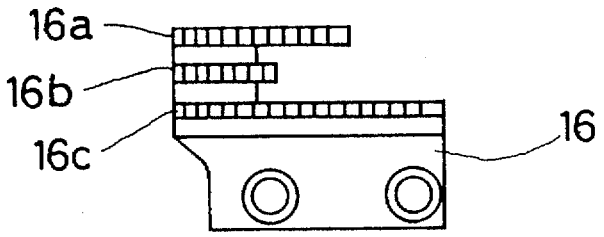
FIG. 5 is a plan view of a feed dog.
Figure 6:
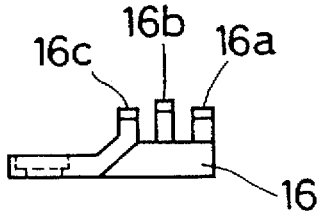
FIG. 6 is a side view of a feed dog.

As shown in FIG. 5 and FIG. 6, the feed dog 16 is provided with three racks 16*a*, 16*b*, 16*c* of different lengths like the guide grooves 5*a*, 5*b*, 5*c* provided in the throat plate 5, so as to project from the upper surface. The middle rack 16*b* of the three racks 16*a*, 16*b*, 16*c* is set to be higher than the other racks 16*a* and 16*c* by about 0.2 mm.

Figure 9:
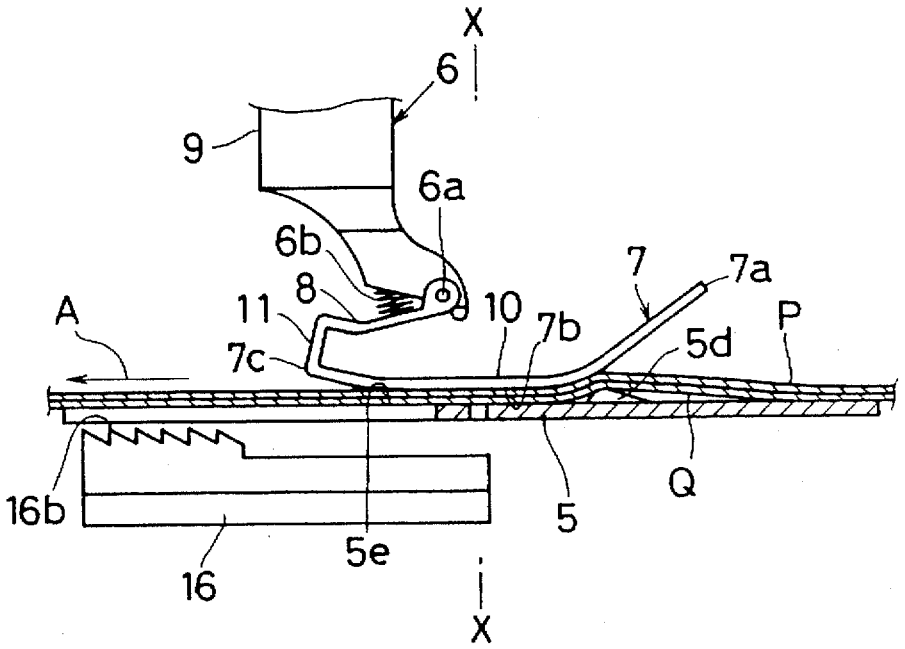
FIG. 9 is a magnified sectional view along line IX—IX in FIG. 2 for explaining the braking action of the sewing deviation preventive apparatus of the invention.

When sewing the fabrics P, Q by the sewing machine thus constituted, as shown in FIG. 9, the fabrics P, Q are put on the throat plate 5, the presser foot 7 is lowered to arrest the fabrics P, Q against the upper surface 5*e* of the throat plate 5. At this time, the lower surface 7*b* of the presser foot 7 is in a nearly parallel state holding the fabrics P, Q together with the upper surface 5*e* of the throat plate 5.

The needle 4 is at the position starting to fall from the highest position of the ascending and descending stroke. The feed dog 16 spirally provided on the upper surface of the feed bar 15 is positioned beneath the upper surface 5*e* of the throat plate 5, and is located at a position for starting to traverse (move) in the opposite direction of arrow A about the ascending and descending center line X—X of the needle 4.

Figure 10:
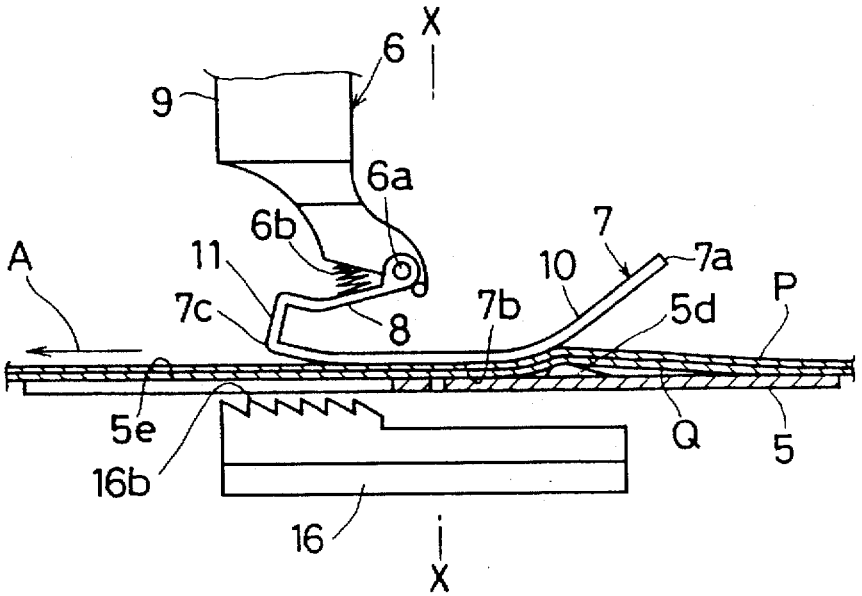
FIG. 10 is a magnified sectional view for explaining the same braking action.

Later, the needle 4 descends along the ascending and descending center line X—X, penetrates through the fabrics P, Q, and then ascends, thereby making a sewing operation. In this process, the feed dog 16 moves laterally in the opposite direction of arrow A about the ascending and descending center line X—X of the needle 4. As shown in FIG. 10, the feed dog 16 is at a position where the rack 16*b* is beneath the flange 8.

Figure 11:
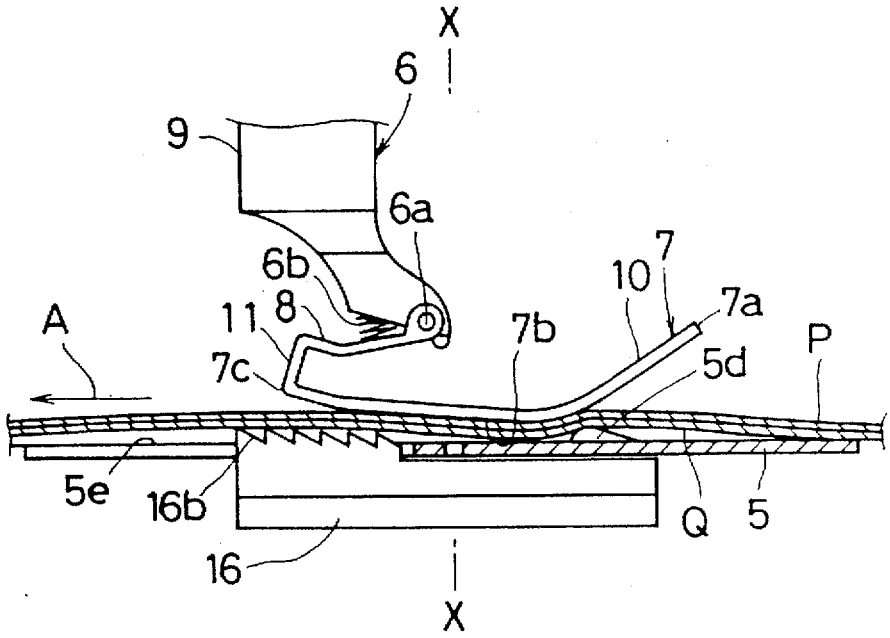
FIG. 11 is a magnified sectional view for explaining the same braking action.

Then, as shown in FIG. 11, after the needle 4 penetrates through the fabrics P, Q, the feed dog 16 ascends, and the racks 16*a*, 16*b*, 16*c* project onto the upper surface 5*e* of the throat plate 5 from the guide grooves 5*a*, 5*b*, 5*c* formed on the throat plate 5. At this time, the presser foot 7 is pushed up through the fabrics P, Q from the lower surface b by the racks 16*a*, 16*b*, 16*c*, and the rack 16*b* moves parallel upward by the portion projecting the upper surface 5*e* of the throat plate 5.

At this time, the presser foot 7 is pressed upward by the feed dog 16, but since the middle rack 16*b* is set about 0.2 mm higher than the both side racks 16*a*, 16*c*, the force is mainly applied from the rack 16. Therefore, the fabrics are gripped mainly by the lower surface 7*b* of the presser foot 7 and the rack 16*b*.

By the action of the coupler 11, since the fluctuations of the interval between the both flanges 8, 10 are allowed, the gripping force of the fabrics P, Q is prevented from increasing abnormally by elevation of the feed dog 16, so that the fabrics P, Q may not be damaged.

Figure 12:
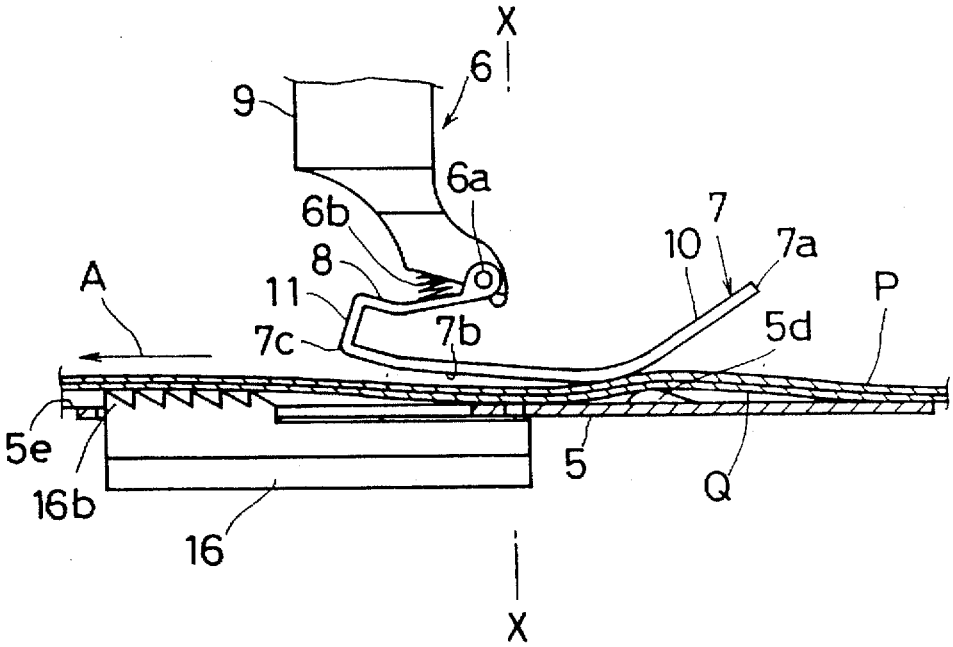
FIG. 12 is a magnified sectional view for explaining the same braking action.

Further, as shown in FIG. 12, the feed dog 16 moves in the direction of arrow A in the state projecting from the upper surface 5*e* of the throat plate 5, at an intermediate descending position of the needle 4. As a result, since the fabrics P, Q are mainly suppressed by the lower surface 7*b* of the presser foot 7 and the rack 16*b*, they are pulled in the direction of arrow A, and are fed only by the moving distance of the feed dog 16.

Herein, the presser foot 7 is rotatable through the horizontal shaft 6*a*, and is thrust by the spring 6*b*, and as the rack 16*b* moves in the direction of arrow A, the leading end 7*a* receives a force in a direction of rotating upward about the horizontal shaft 6*a*. As a result, the presser foot 7 is changed from the state of its lower surface 7*b* nearly parallel to the upper surface 5*e* of the throat plate 5, to the state of the rear end 7*c* slightly inclined downward. Therefore, the fabrics P, Q are pressed against the bump 5*d* formed on the upper surface 5*e* of the throat plate 5.

Herein, since the fabrics P, Q are most strongly pressed by the rack 16*b* of the feed dog 16, when the feed dog 16 traverses, they are pressed and pulled most strongly just before the needle hole O (the left side in the drawing). Moreover, immediately after the needle hole O (the right side in the drawing), the fabrics P, Q are held between the bump 5*d* formed on the upper surface 5*e* of the throat plate 5 and the lower surface 7*b* of the presser foot 7, and therefore between these two points, the fabric P and the fabric Q are moved in the direction of arrow A without causing deviation or lashing. Moreover, if the gripping force is strong due to thickness of the fabrics P, Q or other cause, the entire lower surface 7*b* of the other flange 10 is pressed against the fabrics P, Q by the elasticity occurring between the both flanges 8 and 10, so that the fabrics P, Q may be fed securely and stably. Still more, since the fabrics P, Q are not marked by gripping, trouble of sewing deviation due to marking is avoided. The presser foot 7 presses the fabrics P, Q by patting, but since occurrence of vibration is suppressed, unstable feeding of fabrics P, Q due to vibration is avoided. At the same time, the noise is decreased.

Thus, in this sewing deviation preventive apparatus, when the feed dog 16 traverses from the state in FIG. 11 to the state shown in FIG. 12, in particular, the fabrics P, Q are most strongly pressed and pulled securely just before the needle hole O (left side in the drawing) by its rack 16*b*. Besides, immediately after the needle hole O (right side in the drawing), since the fabrics P, Q are held between the bump 5*d* formed on the upper surface 5*e* of the throat plate 5 and the entire lower surface 7*b* of the presser foot 7, the fabric P and fabric Q are moved securely as being pulled more strongly between these two points. Therefore, in the state free from deviation, lashing, corrugation or the like, the sewing needle 4 descends and sews.

In this sewing deviation preventive apparatus, moreover, depending on the thickness of the fabrics P, Q, it is possible to cope with flexibly by the fluctuations of the interval of the both flanges 8, 10 of the presser foot 7, and no particular mechanism for adjusting the interval of the cloth presser 6 and feed dog 16 is needed. Still more, if the thickness of the fabrics P, Q changes during sewing, similarly, it is possible to cope with by the fluctuations of the interval of the both flanges 8, 10, so that the sewing operation can be continued.

In this embodiment, if the other flange 10 is immediately above the needle hole O, it is designed to avoid the needle 4 by a slit (not shown), and therefore, as compared with the conventional constitution, it is possible to bring the horizontal shaft 6*a* closer to the axial line of the needle hole O, and in particular near the needle hole O, the pressing force acing on the presser foot 7 acts efficiently to hold the cloth securely, so that the sewing precision may be further enhanced. Besides, the pressing force may be applied uniformly on the entire other flange 10, so that the fabrics P, Q may be pressed evenly.

Incidentally, the presser foot 7 is not limited to the U-shaped spring body alone, but, for example, a metal plate may be adhered to the bottom of an elastic member made of a highly elastic material such as rubber.

The elastic member may be, aside from the coupler 11 shown in the embodiment, an elastic body interposed between the cloth presser main body 9 and the presser foot 7 (see spring 6).

The rack 16*b* of the feed dog 16 is set higher than the other racks 16*a*,16*c* by about 0.2 mm, but it may be set at an arbitrary height depending on the material or thickness of the fabrics P, Q.

Similarly, the bump 5*d* formed on the upper surface 5*e* of the throat plate 5 may be set in a desired size.

Figure 7:
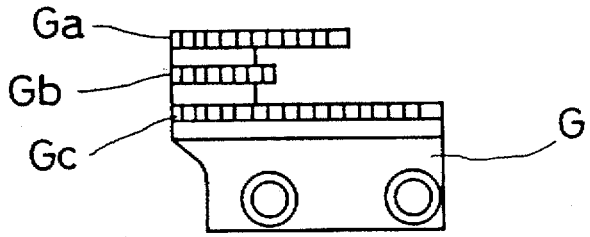
FIG. 7 is a plan view of a comparative example of feed dog.
Figure 8:
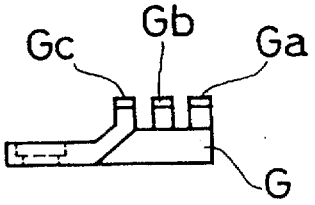
FIG. 8 is a side view of a comparative example of feed dog.

As shown in FIG. 7 and FIG. 8, in the feed dog G of the comparative example used hitherto, three racks Ga, Gb, Gc are same in height, and the racks Ga, Gc of this feed dog G may be partly modified to prepare a feed dog 16 with a high rack 16*b* as shown in FIG. 5 and FIG. 6.

The foregoing embodiment relates to a sewing deviation preventive apparatus of cloth sewn by a sewing machine with one needle 4, but it may be also applied to a sewing machine with multiple needles, and similar actions and effects are applied when used in various sewing machines such as rocking sewing machine for chain stitch.

In short, according to the sewing deviation preventive apparatus in any one of claims 1 to 3, the abutting portion 10 of the presser foot 7 is coupled and supported by an elastic member (see the coupler 11 or spring 6*b*), and the dislocation of the presser foot 7 is allowed by deformation of the elastic member, and therefore the following effects are brought about.

(1) Gripping of the fabrics P, P by the abutting portion 10 of the presser foot 7 and the feed dog 16 is always stable, flexibly corresponding to the thickness of the fabrics P, Q, so that feeding is secure.

(2) If the thickness of the fabrics P, Q varies in the midst of sewing, it is possible to grip with a proper gripping force, and in cooperation with the feed dog 16, feeding of the fabrics P, Q can be continued without interrupting.

(3) The presser foot feeds the fabrics P, Q forward in the feed direction by pressing like patting, simultaneously with sewing of the fabrics P, Q. At this time, by deformation of the elastic member, the entire lower surface of the abutting portion 10 of the presser foot 7 is pressed to the fabrics P, Q to grip, so that the fabrics P, Q can be fed stably and securely without causing corrugation, lashing, etc.

(4) The impact when gripping the fabrics P, Q is absorbed by the elastic member, and generation of vibration is suppressed, and hence feeding and sewing of the fabrics P, Q are securer and stabler, while the noise is reduced.

(5) Owing to these effects, feed of fabrics P, Q is always stable and secure regardless of the thickness, and sewing operation is done stably, so that the quality of obtained products is enhanced.

According to the sewing deviation preventive apparatus of claim 4, in addition, it is possible to cope with the thickness changes of the fabrics P, Q by fluctuations of spacing dimension between the both flanges 8, 10 of the presser foot 7, and the presser foot 7 is a spring body made of a metal plate formed in a U-shape, and therefore the structure is simple, it is possible to manufacturer easily, and it is easy to lower the cost and reduce the size.

In the presser foot 7, meanwhile, when the projecting dimension of the other flange 11 from the coupler 11 is set larger than that of the flange 8, the pressing force of the cloth presser 6 for holding down the cloth can act in a wide range. By adjusting the shape of the other flange 19 (for example, forming a slit for penetrating needle) to avoid the needle 4, the action point of pressing force at one flange 8 can be brought closer to immediately above the needle hole O, so that the peripheral cloth of the needle hole O can be compared securely.

Herein, the U-shape of the presser foot 7 includes various similar forms such as the pi-shape.

Thus, according to the invention, regardless of the material, thickness or kind of cloth, and knitting or braiding method, secure sewing deviation prevention means not influenced by stretching of cloth or the like may be formed in a simple constitution, and hence a sewing deviation preventive apparatus of cloth sewn by sewing machine effectively applicable to newly developed materials can be presented.

What is claimed is:

1. A device of preventing sewing deviation, comprising:

a throat plate comprising an upper surface and forming a needle hole through which a sewing needle penetrates, said upper surface having a raised portion;

a feed dog moving in and out of said throat plate, said feed dog having a jagged upper surface for securely holding a cloth being sewn;

a cloth presser located above said needle hole and comprising a main body and a presser foot for pressing the cloth being sewn at a leading edge thereof, said presser foot being disposed above said raised portion of said throat plate upper surface; and an elastic member; wherein an abutting portion of said presser foot is in contact with said cloth being sewn and is coupled to and supported by said elastic member.

2. The device of claim 1, wherein said elastic member is disposed on said presser foot.

3. The device of claim 1, wherein said elastic member is disposed between said main body of said cloth presser and said presser foot.

4. The device of claim 2, wherein said presser foot of said cloth presser comprises a metallic spring body formed in a U shape, a first flange formed in a U shape and coupled to said main body of said cloth presser, a second flange disposed parallel to said upper surface of said throat plate and apart from said first flange, and coupling portion for coupling said first and second flanges.

* * * * *